US010498087B2

(12) United States Patent
Zhao

(10) Patent No.: US 10,498,087 B2
(45) Date of Patent: Dec. 3, 2019

(54) ELECTRICAL CONNECTOR HAVING A SHIELDING SHELL WITH A PAIR OF LATERALLY EXTENDING SPRING TANGS

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/868,050

(22) Filed: Jan. 11, 2018

(65) Prior Publication Data

US 2018/0198240 A1 Jul. 12, 2018

(30) Foreign Application Priority Data

Jan. 11, 2017 (CN) ..... 2017 1 0024546

(51) Int. Cl.
*H01R 13/6582* (2011.01)
*H01R 13/6594* (2011.01)
*H01R 24/60* (2011.01)

(52) U.S. Cl.
CPC ..... *H01R 13/6582* (2013.01); *H01R 13/6594* (2013.01); *H01R 24/60* (2013.01)

(58) Field of Classification Search
CPC ..... H01R 13/6582; H01R 13/6594
See application file for complete search history.

(56) References Cited

U.S. PATENT DOCUMENTS

| | | | | |
|---|---|---|---|---|
| 7,097,507 | B1 * | 8/2006 | Zhang | H01R 13/6582 439/607.35 |
| 8,535,097 | B2 * | 9/2013 | Yen | H01R 13/6594 439/607.27 |
| 8,690,605 | B2 * | 4/2014 | Wang | H01R 13/504 439/607.27 |
| 8,926,367 | B2 * | 1/2015 | Hsu | H01R 13/658 439/607.35 |
| 9,350,126 | B2 | 5/2016 | Little et al. | |
| 9,484,679 | B2 | 11/2016 | Guo et al. | |
| 9,653,850 | B1 | 5/2017 | Su et al. | |
| 9,680,254 | B1 * | 6/2017 | Nishikata | H01R 13/627 |
| 2006/0154524 | A1 * | 7/2006 | Huang | H01R 13/6273 439/607.01 |

(Continued)

FOREIGN PATENT DOCUMENTS

| | | |
|---|---|---|
| CN | 104733923 A | 6/2015 |
| CN | 104836051 A | 8/2015 |
| CN | 105552618 A | 5/2016 |

*Primary Examiner* — Briggitte R. Hammond
(74) *Attorney, Agent, or Firm* — Wei Te Chung; Ming Chieh Chang

(57) ABSTRACT

An electrical connector includes: an insulative housing having a base and a tongue; an upper and lower rows of contacts secured to the housing and exposed respectively to an upper and lower surfaces of the tongue; a shielding shell enclosing the insulative housing, the shielding shell having a pair of spring tangs; and a metallic shield attached to an outer side of the shielding shell, wherein the spring tang extends laterally in a cantilevered manner, and the metallic shield has a pair of recesses for accommodating an outward movement of the pair of spring tangs.

7 Claims, 9 Drawing Sheets

(56) References Cited

U.S. PATENT DOCUMENTS

| | | | | |
|---|---|---|---|---|
| 2010/0022132 | A1* | 1/2010 | Wang | H01R 13/6582<br>439/607.27 |
| 2010/0035465 | A1* | 2/2010 | Wang | H01R 13/502<br>439/541.5 |
| 2011/0256766 | A1* | 10/2011 | Chiang | H01R 13/6595<br>439/607.27 |
| 2012/0052698 | A1* | 3/2012 | Shu | H01R 13/6594<br>439/55 |
| 2015/0229077 | A1* | 8/2015 | Little | H01R 12/724<br>439/78 |
| 2015/0244118 | A1* | 8/2015 | Lin | H01R 24/60<br>439/357 |
| 2016/0079713 | A1* | 3/2016 | Yu | H01R 13/6582<br>439/607.27 |
| 2016/0126677 | A1* | 5/2016 | Yu | H01R 13/6474<br>439/607.23 |
| 2016/0141805 | A1* | 5/2016 | Zhao | H01R 13/504<br>439/607.01 |
| 2016/0141806 | A1* | 5/2016 | Guo | H01R 13/504<br>439/607.01 |
| 2016/0233620 | A1 | 8/2016 | Xing et al. | |

* cited by examiner

ELECTRICAL CONNECTOR HAVING A SHIELDING SHELL WITH A PAIR OF LATERALLY EXTENDING SPRING TANGS

BACKGROUND OF THE INVENTION

1. Field of the Invention

The present invention relates generally to an electrical connector including a shielding shell having a pair of spring tangs and an outer metallic shield attached to an outer side of the shielding shell, wherein the spring tang extends laterally in a cantilevered manner so that a size of the outer metallic shield may be reduced.

2. Description of Related Art

China Patent No. 104733923 discloses provision of spring tangs on shielding shells or outer metallic shields. U.S. Pat. No. 9,653,850 discloses an electrical connector including a shielding shell having a pair of holes and an outer metallic shield having a pair of spring tangs extending through the pair of holes, respectively.

China Patent No. 104836051 and U.S. Patent Application Publication No. 2016/0233620 each disclose meandering spring tangs that extend laterally in a cantilevered manner.

SUMMARY OF THE INVENTION

An electrical connector comprises: an insulative housing having a base and a tongue; an upper and lower rows of contacts secured to the housing and exposed respectively to an upper and lower surfaces of the tongue; a shielding shell enclosing the insulative housing, the shielding shell having a pair of spring tangs; and a metallic shield attached to an outer side of the shielding shell; wherein the spring tang extends laterally in a cantilevered manner; and the metallic shield has a pair of recesses for accommodating an outward movement of the pair of spring tangs.

DETAILED DESCRIPTION OF THE PREFERRED EMBODIMENT

Figure 1:
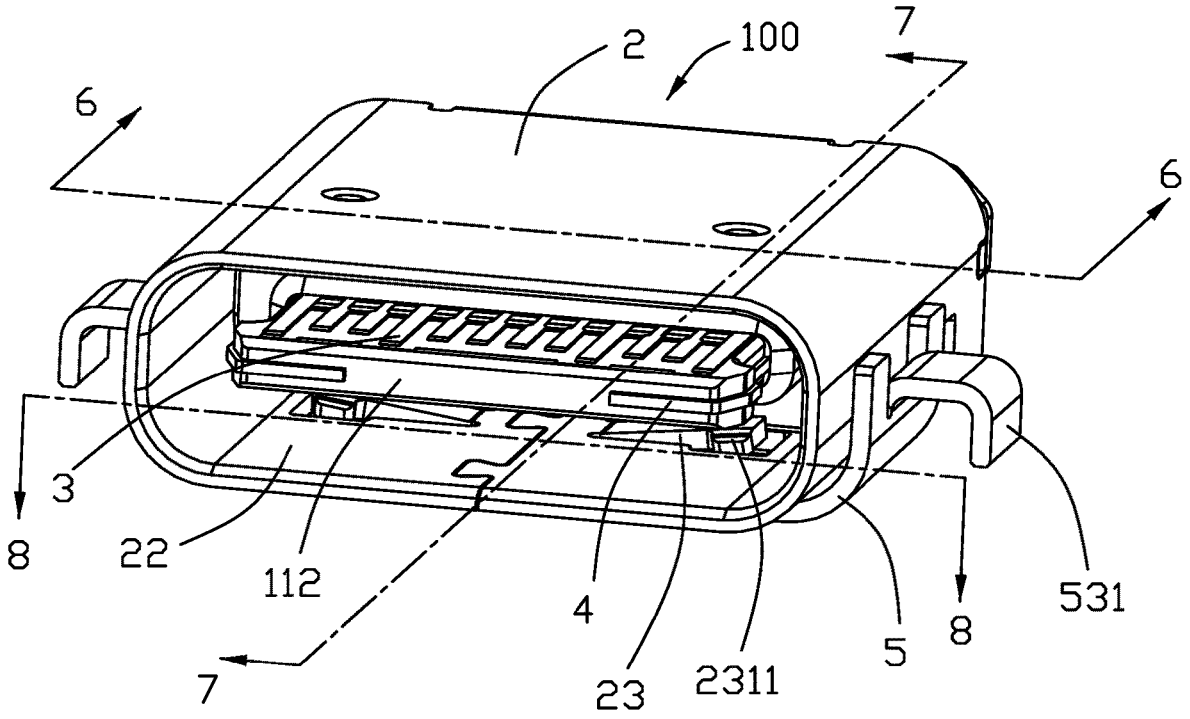
FIG. 1 is a front and top perspective view of an electrical connector in accordance with the present invention.
Figure 2:
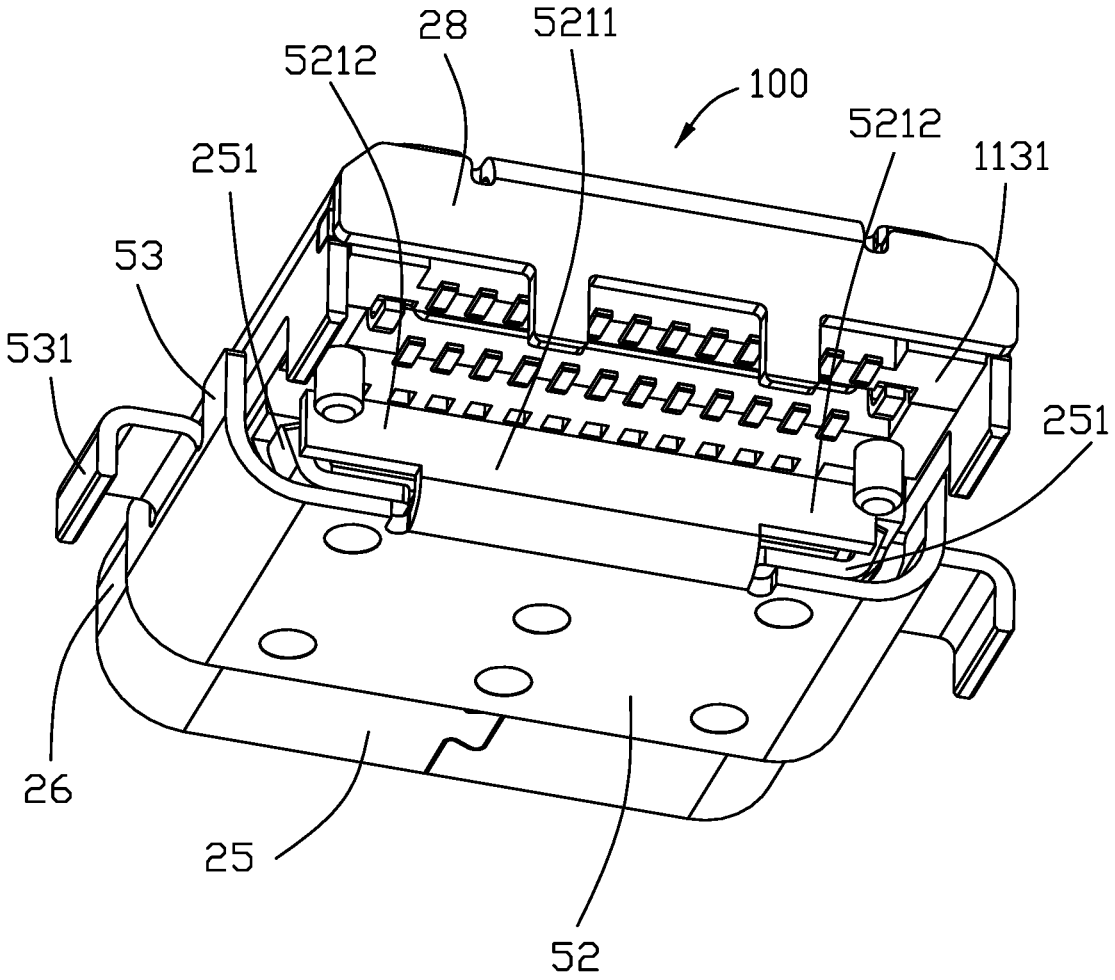
FIG. 2 is a rear and bottom perspective view of the electrical connector.
Figure 3:
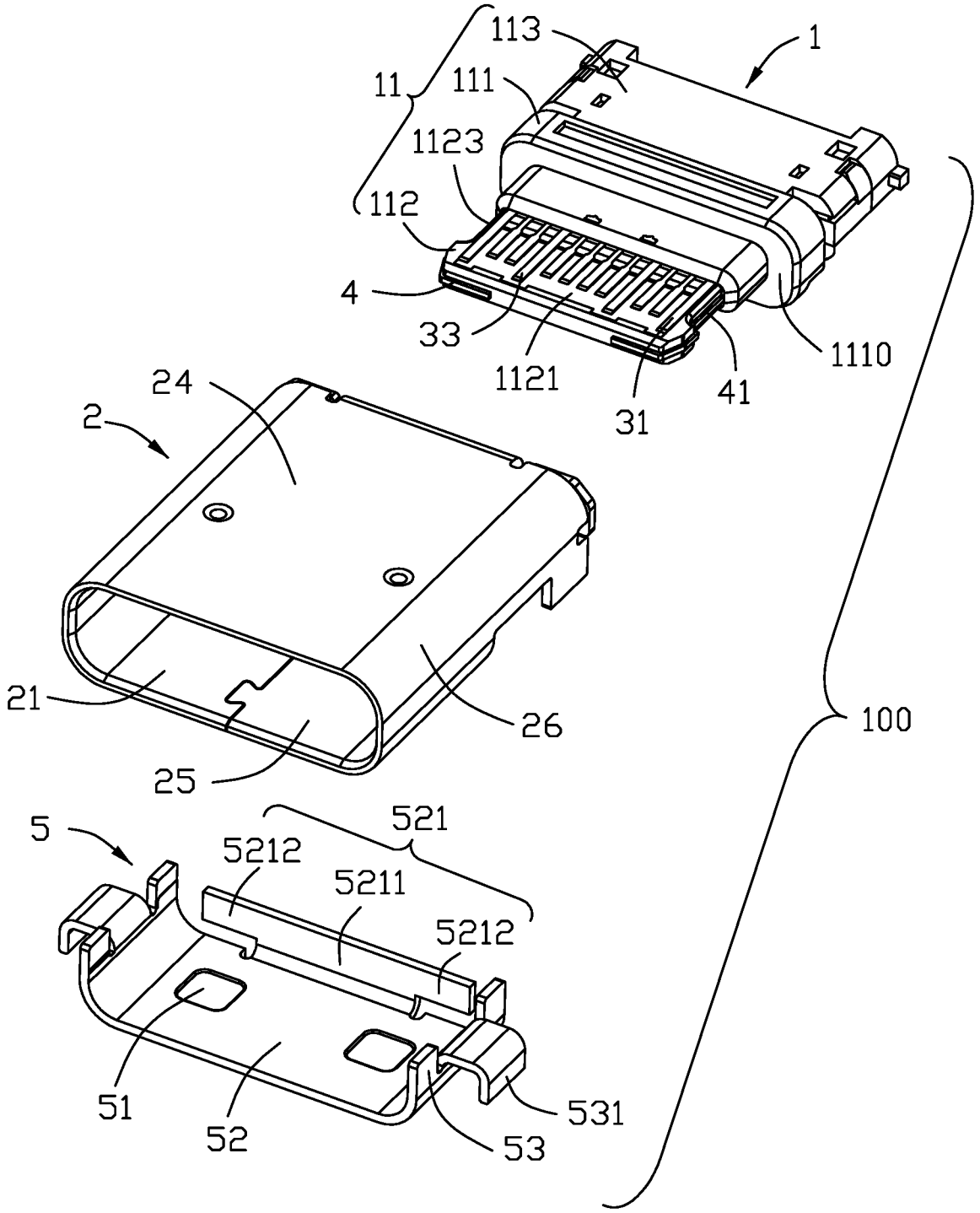
FIG. 3 is an exploded view of the electrical connector.
Figure 4:
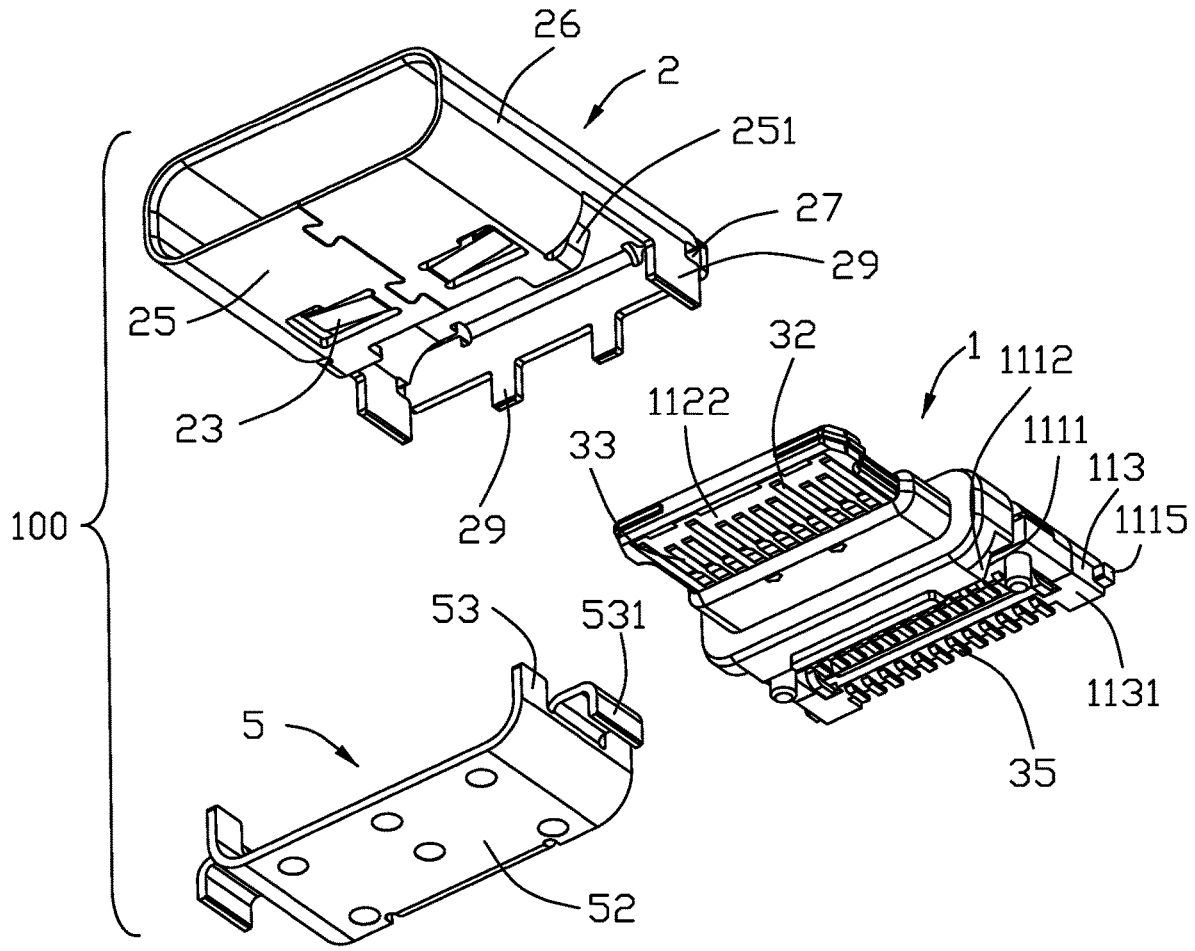
FIG. 4 is a view similar to FIG. 3 but from a different perspective.
Figure 5:
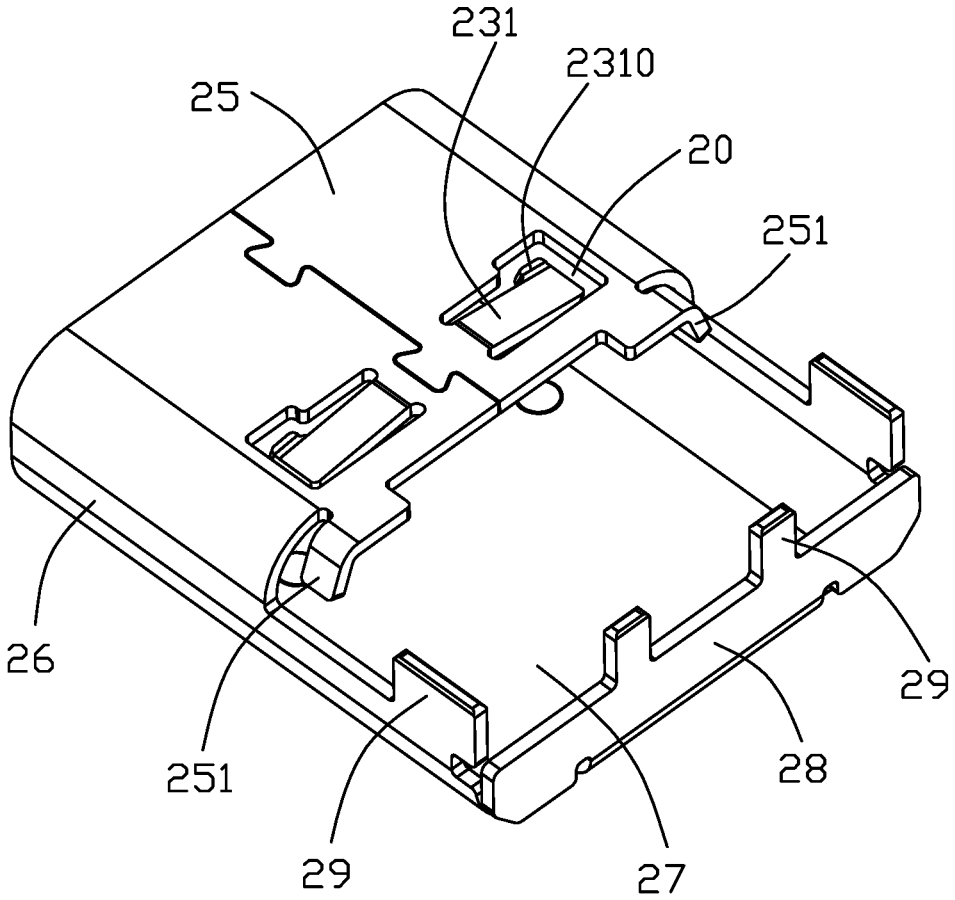
FIG. 5 is an exploded view of a shielding shell of the electrical connector.
Figure 6:
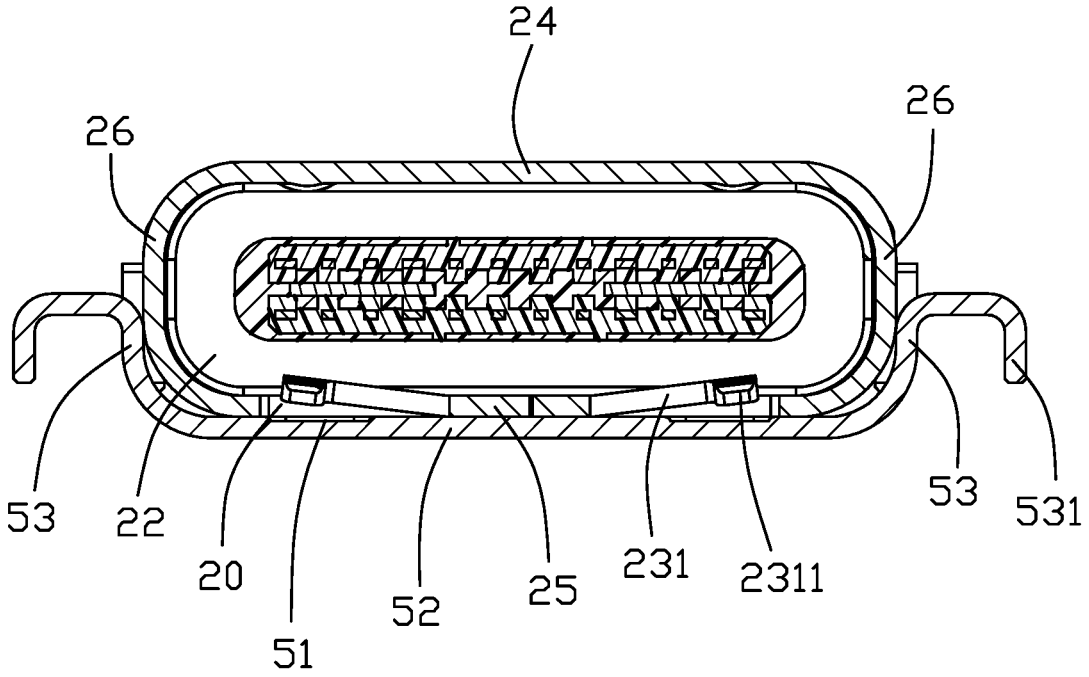
FIG. 6 is a cross-sectional view of the electrical connector taken along line 6-6 in FIG. 1.
Figure 7:
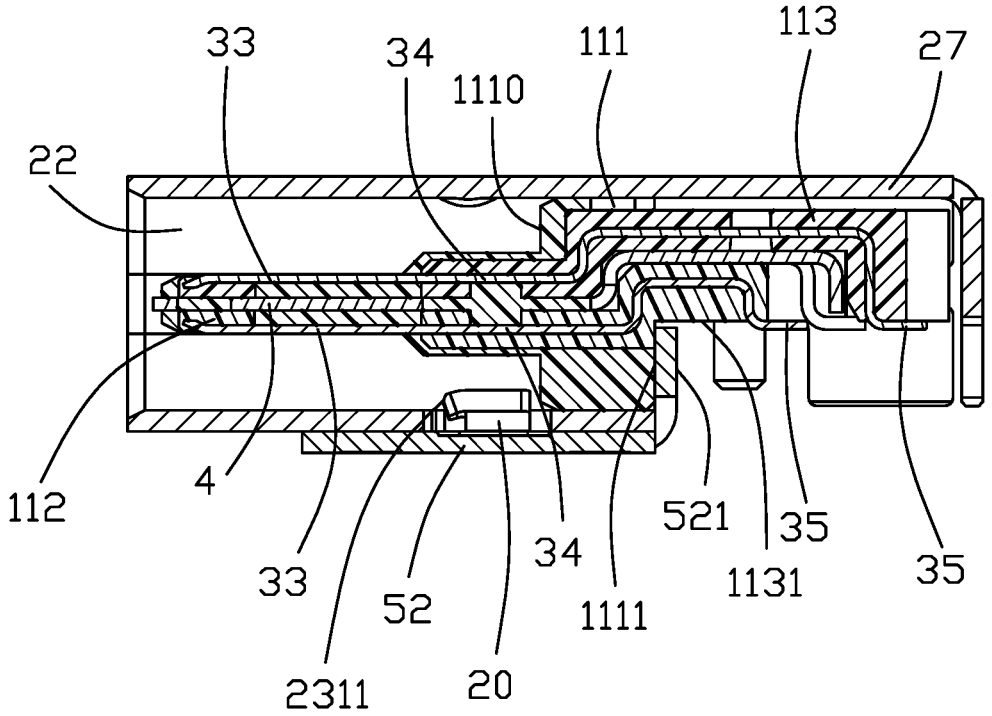
FIG. 7 is a cross-sectional view of the electrical connector taken along line 7-7 in FIG. 1.
Figure 8:
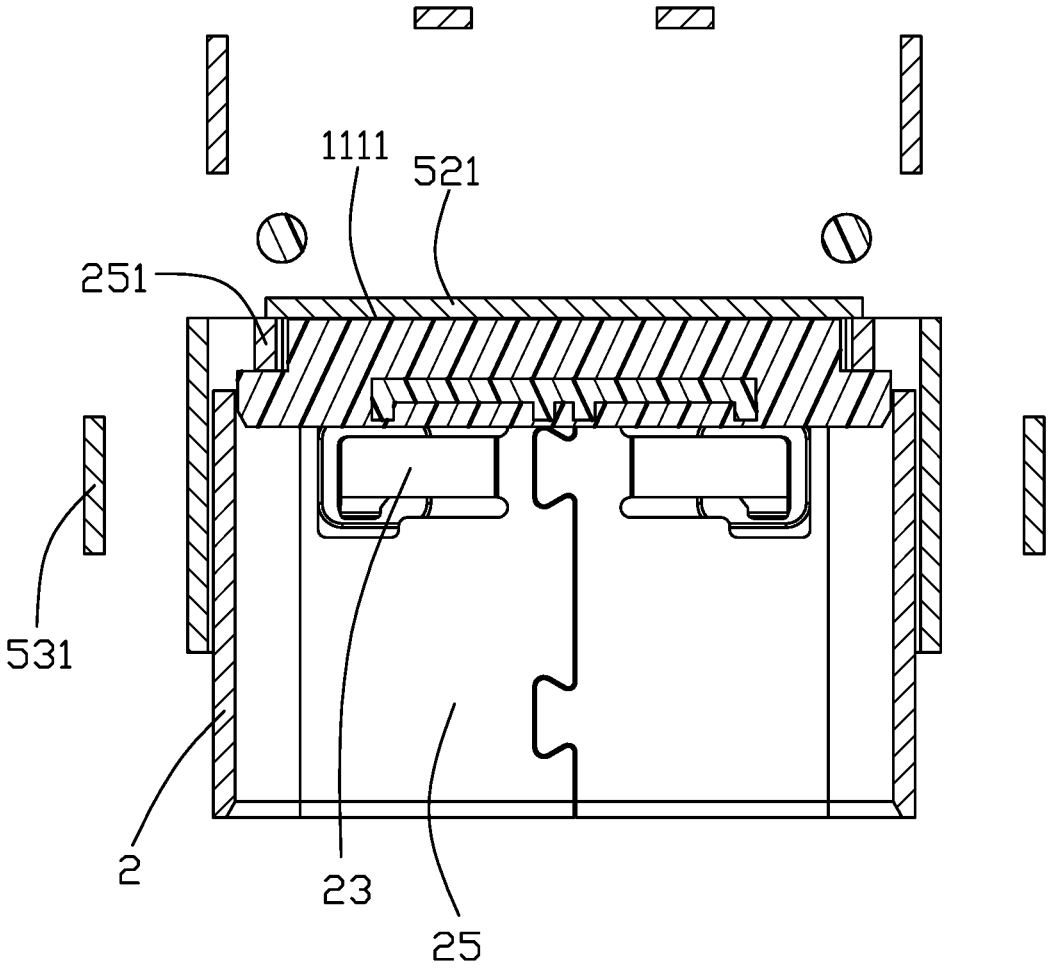
FIG. 8 is a cross-sectional view of the electrical connector taken along line 8-8 in FIG. 1.
Figure 9:
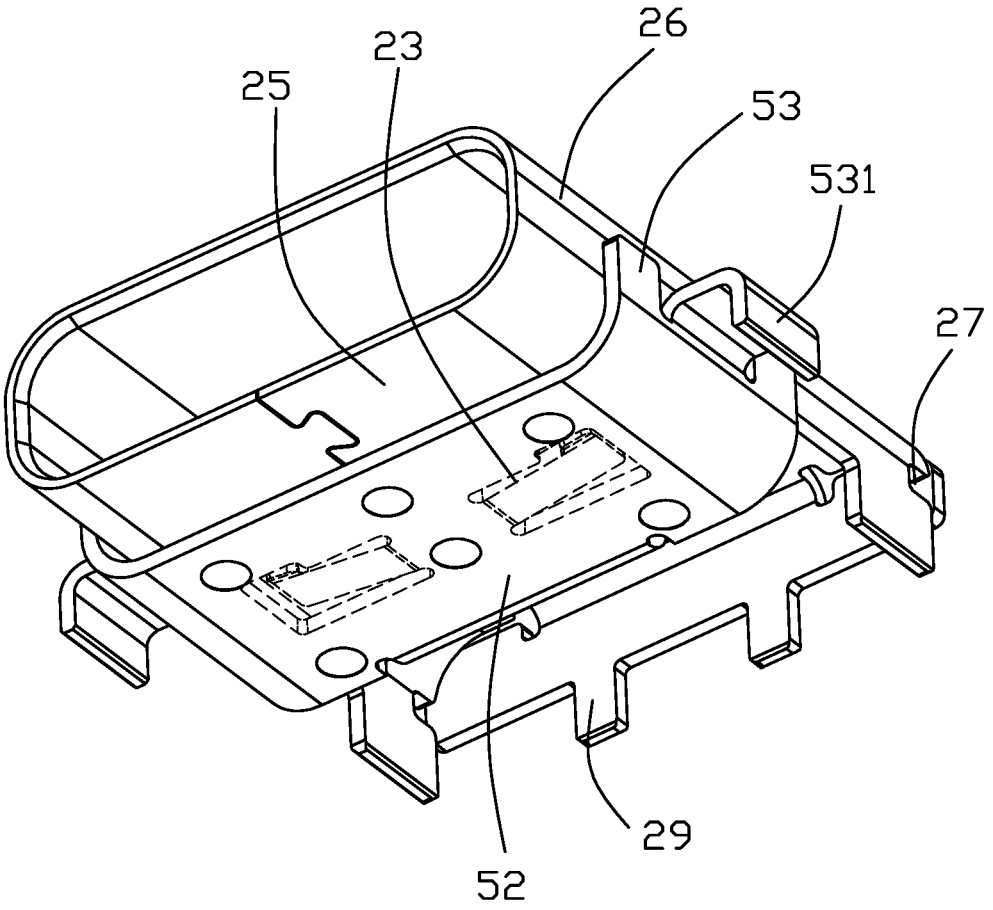
FIG. 9 is a bottom view of a combination of the shielding shell and the metallic shield to show the pair of spring tangs are essentially aligned with the pair of legs 531 in the transverse direction.

Referring to FIGS. 1 to 8, an electrical connector 100 comprises a contact module 1, an (inner) shielding shell 2 enclosing the contact module 1 to define a receiving space 21, and an (outer) metallic shield 5 attached to the shielding shell 2.

The contact module 1 includes an insulative housing 11 and a plurality of contacts 3 secured to the insulative housing 11. The insulative housing 11 includes a base 111 having a front face 1110 and a tongue 112 extending forwardly from the base 111 in a front-to-back direction in the space 21 to form a chamber 22 for receiving a complementary plug. The plurality of contacts 3 include an upper row of contacts 31 and a lower row of contacts 32. Each of the upper contact 31 and the lower contact 32 has a contacting portion/section 33 exposed to a respective one of two opposite surfaces 1121 and 1122 of the tongue 112, a soldering tail 35, and a securing portion 34 therebetween. A metal piece 4 is disposed between the upper row of contacts 31 and the lower row of contacts 32. The tongue 112 has a pair of notches 1123 exposing two opposite sides 41 of the metal piece 4. A rear extension 113 is disposed at an upper of a rear face 1111 of the base 111 to form a mounting face 1131 exposing the soldering tails 35.

The shielding shell 2 has a pair of spring tangs 23 in corresponding openings 20 thereof for engaging an inserted mating connector. The spring tang 23 extends laterally in a cantilevered manner as a spring arm 231 so as to have a reduced dimension along a mating direction. The shielding shell 2 has a top wall 24, a bottom wall 25, and a pair of side walls 26. The pair of spring tangs 23 are disposed at the bottom wall 25. The base 111 has a pair of limiting slots 1112 at a lower of the rear face 1111 and the shielding shell bottom wall 25 has a pair of pawls 251 engaging the slots 1112 for preventing rearward movement of the housing 11 relative to the shielding shell 2. The spring tang 23 has a front protrusion 2310 around a free and extending in the mating direction and a guiding face 2311 formed on the protrusion 2310. The shielding shell 2 further includes a pair of notches 27 to receive the corresponding blocks 1115 therein for preventing further movement of the housing 11 relative to the shielding shell 2.

The metallic shield 5 is spot welded to the shielding shell bottom wall 25, which also assists in water and moisture-proof. The metallic shield 5 has a pair of recesses 51 for accommodating an outward movement of the pair of spring tangs 23. The metallic shield 5 includes a main part 52 and a pair of side walls 53. The side wall 531 has a pair of mounting legs 531 for mounting to a printed circuit board (not shown). The metallic shield main part 52 has a rear wall 521 extending upward to a level substantially flush with the mounting face 1131. The rear wall 521 has a middle portion 5211 situated between the pair of pawls 251 to forwardly abut against the rear face 1111 of the base 11, and a pair of side portions 5212 located by two sides of the middle portion 5211 and situated behind the pair of pawls 251 for forwardly abut against the pawls 251. The shielding shell 2 further has a covering portion 27 and a rear portion 28 around the rear extension 113. The rear portion 28 extends downward to a level also substantially flush with the mounting face 1131, which together with the rear wall 521 provides a desired shielding. Both the covering portion 27 and the rear portion 28 have soldering legs 29.

Notably, in the traditional design, the corresponding spring tangs extend along the front-to-back direction with the corresponding opening having a dimension more than one half of that of the chamber surrounded by the inner shielding shell so as to have the corresponding outer metallic shield dimensioned at least one half of the chamber in the front-to-back direction, thus costing material and money disadvantageously. In the invention, the corresponding opening is dimensioned less than one half of the chamber in the front-to-back direction so as to have the corresponding outer metallic shield dimensioned less than one half or even one third of the chamber in the front-to-back direction, thus saving material and money advantageously. In this embodiment, the spring tang is located around the rear half of the chamber surrounded by the inner shielding shell and extends along the transverse direction with a dimension around one half of that of the chamber in the front-to-back direction. In this embodiment, the pair of spring tangs are essentially aligned with the corresponding legs 531 in the transverse direction.

What is claimed is:

1. An electrical connector comprising:

a contact module including an insulative housing and a plurality of contacts retained in the housing, the housing including a base and a tongue extending forwardly from the base in a front-to-back direction, and forming opposite mating surfaces in a vertical direction perpendicular to said front-to-back direction, said contacts forming contacting sections exposed upon opposite mating surfaces, respectively;

an inner metallic shielding shell enclosing the housing to define a receiving space in which the tongue extends with a chamber therebetween for receiving a complementary connector, said shielding shell further includes a pair of openings with a pair of corresponding spring tangs stamped therefrom to extend in a transverse direction perpendicular to both the front-to-back direction and the vertical direction into the chamber; and an outer metallic shield attached upon the metallic shielding shell to cover said pair of openings in the vertical direction; wherein each of said spring tangs extends in a cantilevered manner, and has a protrusion located at a free end with a guiding face thereof and extending forwardly in the front-to-back direction.

2. The electrical connector as claimed in claim 1, wherein a dimension of each of said openings in the front-to-back direction is less than one half of the chamber in the front-to-back direction.

3. The electrical connector as claimed in claim 2, wherein said pair of openings are located around a rear half of the chamber.

4. The electrical connector as claimed in claim 1, wherein said pair of spring tangs extend away from each other in the transverse direction.

5. The electrical connector as claimed in claim 1, wherein the housing includes at a block forwardly abutting against the inner metallic shielding shell for preventing forward movement of the housing relative to the inner metallic shielding shell, and the inner metallic shielding shell includes a pawl forwardly abutting against the housing for preventing rearward movement of the housing relative to the inner metallic shielding shell.

6. The electrical connector as claimed in claim 1, wherein said outer metallic shield further includes a pair of recesses for accommodating the protrusions of the pair of spring tangs, respectively, when said spring tangs are outwardly deflected by a complementary plug inserted into the chamber.

7. The electrical connector as claimed in claim 1, wherein said outer metallic shield includes a pair of mounting legs for mounting to a printed circuit board.

* * * * *